US007725961B2

(12) United States Patent
Martinez et al.

(10) Patent No.: US 7,725,961 B2
(45) Date of Patent: Jun. 1, 2010

(54) PORTABLE TOILET

(75) Inventors: Miguel O. Martinez, Oakland Park, FL (US); Patrick J. Curran, Pompano Beach, FL (US); Edward F. McKiernan, Wooster, OH (US); Otto E. Erbacher, Shreve, OH (US); Robert D. Krieder, Sullivan, OH (US)

(73) Assignee: Dometic Corporation, Elkhart, IN (US)

( * ) Notice: Subject to any disclaimer, the term of this patent is extended or adjusted under 35 U.S.C. 154(b) by 1176 days.

(21) Appl. No.: 11/269,425

(22) Filed: Nov. 8, 2005

(65) Prior Publication Data

US 2006/0191065 A1 Aug. 31, 2006

Related U.S. Application Data

(60) Provisional application No. 60/626,591, filed on Nov. 10, 2004.

(51) Int. Cl.
*E03D 1/00* (2006.01)

(52) U.S. Cl. ..... 4/321; 4/236; 4/242.1

(58) Field of Classification Search ..... 4/236, 4/240, 242.1, 321, 323, 354, 362; 220/203.27; 222/401

See application file for complete search history.

(56) References Cited

U.S. PATENT DOCUMENTS 119,641 A * 10/1871 Powell ..... 222/401
1,033,136 A * 7/1912 Wennersten ..... 220/203.27 X
3,251,068 A * 5/1966 Milette et al. ..... 4/323
3,727,242 A 4/1973 Miller
4,547,916 A 10/1985 Henke et al.
4,603,443 A 8/1986 Stewart
4,962,551 A * 10/1990 Bly ..... 4/480
5,513,395 A 5/1996 Chlebek et al.
5,615,420 A 4/1997 Guyton
6,212,700 B1 4/2001 Giesler et al.

FOREIGN PATENT DOCUMENTS

EP 0 940 510 9/1999
GB 324437 1/1930

* cited by examiner

*Primary Examiner*—Robert M Fetsuga
(74) *Attorney, Agent, or Firm*—Pearne & Gordon LLP

(57) ABSTRACT

A portable toilet is provided comprising a bowl provided with an outlet and at least one spout. A flush tank is adapted to store a fluid, wherein the flush tank is adapted to be pressurized. A manually-actuated pump is in sealed communication with the flush tank, wherein the pump is adapted to cause the flush tank to become pressurized. A pressure relief valve adapted to release pressure from the flush tank. A manually-actuated flush valve is in sealed communication with the flush tank and is normally biased to a closed position. The flush valve includes a fluid outlet connected to the at least one spout and a fluid inlet. A flush valve actuator is disposed outside of the flush tank and is adapted to actuate the flush valve, wherein actuation of the flush valve actuator causes the flush valve to open to permit pressurized fluid contained within the flush tank to be delivered through the at least one spout.

16 Claims, 8 Drawing Sheets

PORTABLE TOILET

RELATED APPLICATIONS

Benefit of priority is claimed from U.S. Provisional Application Ser. No. 60/626,591 filed on Nov. 10, 2004, the complete disclosure of which is hereby expressly incorporated herein by this reference thereto.

FIELD OF THE INVENTION

The present invention relates generally to portable toilets, and more particularly, to portable toilets utilizing a manually-actuated pump to flush the portable toilet.

BACKGROUND OF THE INVENTION

Toilets are often provided in vehicles, such as boats, ships and recreational vehicles, and are often used for camping or other portable purposes. It is conventional practice to flush a portable toilet by using a manually-actuated pump for pumping water or other flushing fluid into the toilet bowl. For example, bellows-style pumps are commonly used to pump the water. However, bellows-style pumps require the user to continuously actuate the pump to maintain a water flow into the toilet bowl, and often the water flow is poor and/or erratic. Some users, such as young users, elderly users, or handicapped users may experience difficulty in using a bellows style pump to maintain a continuous supply of water to the toilet bowl. Alternatively, it is also known to use a powered pump for pumping water or other flushing fluid into the toilet bowl. For example, an electric water pump may be used to pump the water. However, the use of a powered pump requires a power source that may not be available, for example, in smaller vehicles or when the toilet is used for camping. Thus, there is a need for an improved portable toilet that can avoid these problems.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a portable toilet is provided comprising a bowl provided with an outlet and at least one spout. A flush tank is adapted to store a fluid, wherein the flush tank is adapted to be pressurized. A manually-actuated pump is in sealed communication with the flush tank, wherein the pump is adapted to cause the flush tank to become pressurized. A pressure relief valve adapted to release pressure from the flush tank. A manually-actuated flush valve is in sealed communication with the flush tank and is normally biased to a closed position. The flush valve includes a fluid outlet connected to the at least one spout and a fluid inlet. A flush valve actuator is disposed outside of the flush tank and is adapted to actuate the flush valve, wherein actuation of the flush valve actuator causes the flush valve to open to permit pressurized fluid contained within the flush tank to be delivered through the at least one spout.

In accordance with another aspect of the present invention, a portable toilet is provided comprising a bowl provided with an outlet and at least one spout. A flush tank is adapted to store a fluid, wherein the flush tank is adapted to be pressurized. A holding tank has an inlet adapted to receive a waste fluid from the outlet of the bowl. A level indicator device includes a plurality of diaphragms, wherein at least a first diaphragm is spaced a distance from at least a second diaphragm, a sight glass defining an interior area is sealed by the diaphragms, and an indicator fluid is disposed within the interior area. The first diaphragm is configured to flex a predetermined amount based on a level of waste fluid contained within the holding tank to cause the indicator fluid to automatically rise within the interior area of the sight glass.

In accordance with another aspect of the present invention, a portable toilet is provided comprising a holding tank having an inlet adapted to receive a waste fluid and an outlet. An extensible disposal tube is configured to engage the outlet of the holding tank and is adapted to empty the waste fluid from the holding tank.

In accordance with another aspect of the present invention, a portable toilet is provided comprising a portable upper section including a bowl. A flush tank is adapted to store a fluid. A seat assembly includes a seat and a lid adapted to cover the seat. A first hinge is adapted to pivotally attach the lid to the upper section, wherein the lid is adapted to be removed from the upper section when the first hinge is pivoted to a predetermined angle relative to the upper section.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
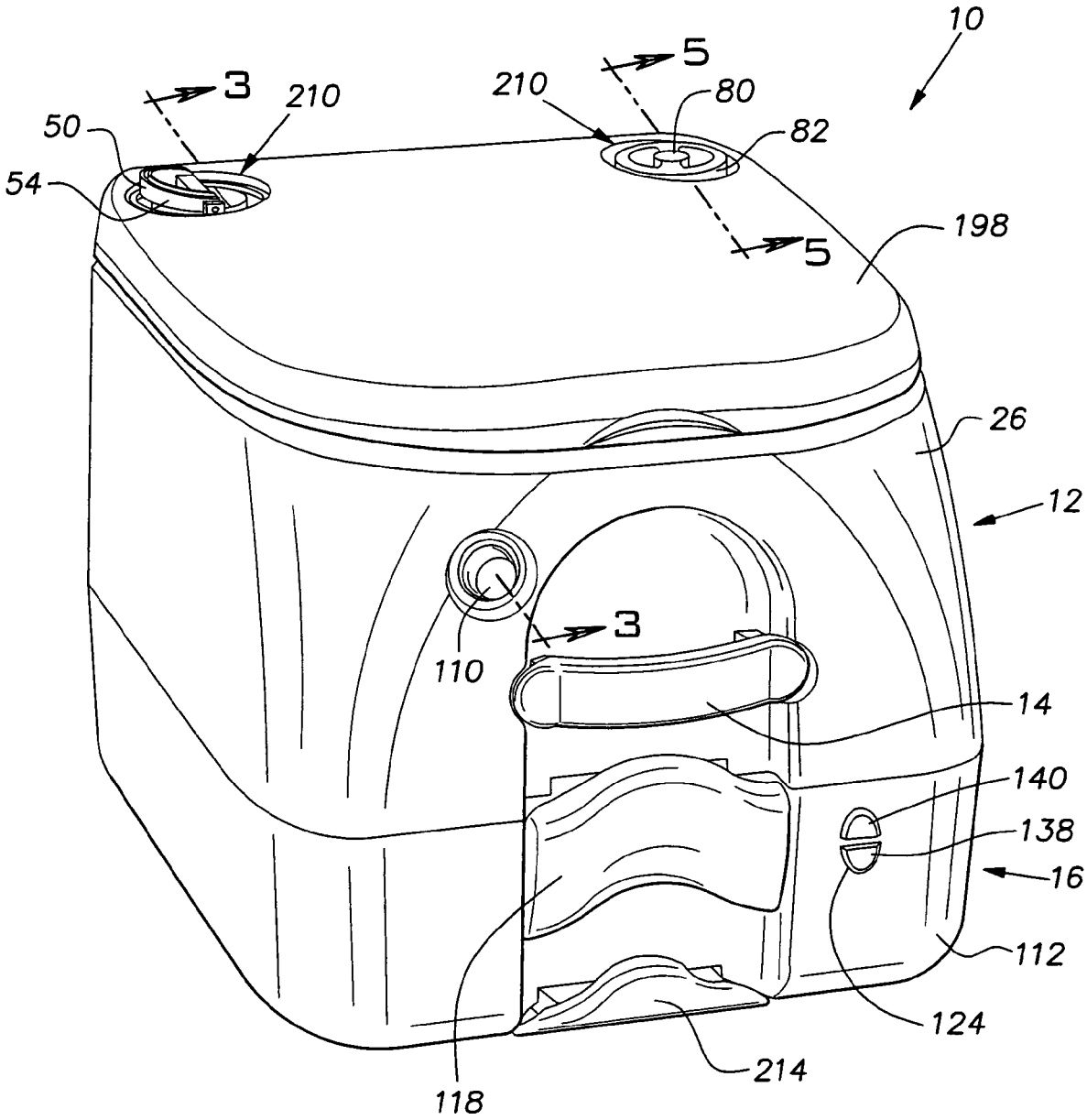
FIG. 1 is a perspective view of an example portable toilet that incorporates an aspect of the present invention.

An example embodiment of a device that incorporates the present invention is shown in the drawings. It is to be appreciated that the shown example is not intended to be a limitation on the present invention. Specifically, the present invention can be utilized in other embodiments and even other types of devices.

Turning to the shown example of FIG. 1, a portable toilet 10 includes a portable upper section 12. The upper section 12 may be adapted for use in any vehicle, such as, for example, boats, ships, or recreational vehicles, or may be adapted for any other portable use, such as, for example, camping. The upper section 12 may include a handle 14 to help transport the portable toilet 10 to various locations. In the shown example, a single handle 14 is disposed towards the front of the upper section 12. It is to be appreciated that the portable toilet 10 may include any number of handles 14 disposed at any location. The portable toilet 10 may further include a lower section 16. In the shown example, the upper section 12 is adapted to be placed directly on top of the lower section 16 and to be removably attached thereto to form the portable toilet 10. It is to be appreciated that when the upper section 12 is placed directly on top of the lower section 16 and attached thereto, the handle 14 is capable of transporting both the upper and lower sections 12, 16 as a single unit. Turning briefly to the example shown in FIG. 9, the upper and lower sections 12, 16 may be attached by a connection member 15 fixedly attached to one of the sections 12, 16 and removably attached to the other. It is also to be appreciated that the upper section 12 and lower section 16 may be separated by a distance and connected either directly or indirectly by, for example, various spacers and/or plumbing.

Figure 2:
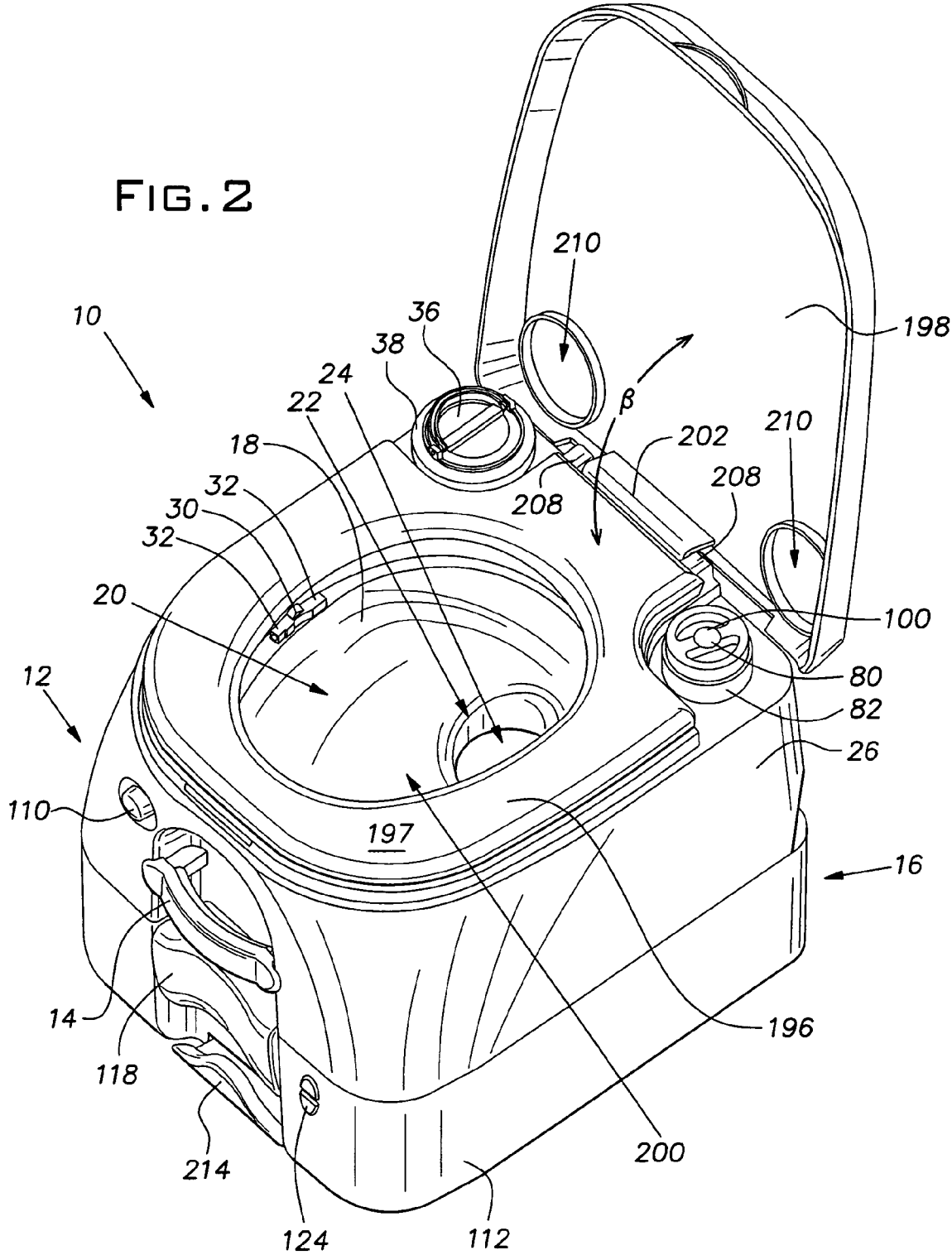
FIG. 2 is similar to FIG. 1, but shows an example lid pivoted to reveal additional features of the present invention.

Turning now to the example shown in FIG. 2, the upper section 12 includes a bowl 18. Turning briefly now to the example shown in FIG. 3, the bowl 18 extends a distance within the upper section 12. It is to be appreciated that the bowl 18 may extend any distance within the upper section 12 as required, and may even be formed with the upper section 12. Returning to the example shown in FIG. 2, the bowl 18 includes a first opening 20 disposed towards the top of the upper section 12 and a second opening 22 disposed towards the bottom of the upper section 12. The first opening 20 of the bowl 18 is adapted to receive excrement (not shown) from a user (not shown) and the second opening 22 is adapted to permit the excrement (not shown) and/or a flushing fluid to exit the bowl 18. In the shown example, the bowl 18 has a generally concave configuration, adapted to direct the excrement from the first opening 20 towards the second opening 22.

The upper section 12 also includes an outlet 24. In the shown example, the outlet 24 comprises a circular hole disposed towards the bottom of the bowl 18 and extending therethrough. It is to be appreciated that the second opening 22 of the bowl 18 may be formed with the outlet 24 of the upper section 12 to provide a continuous path for the excrement to exit the upper section 12.

Figure 3:
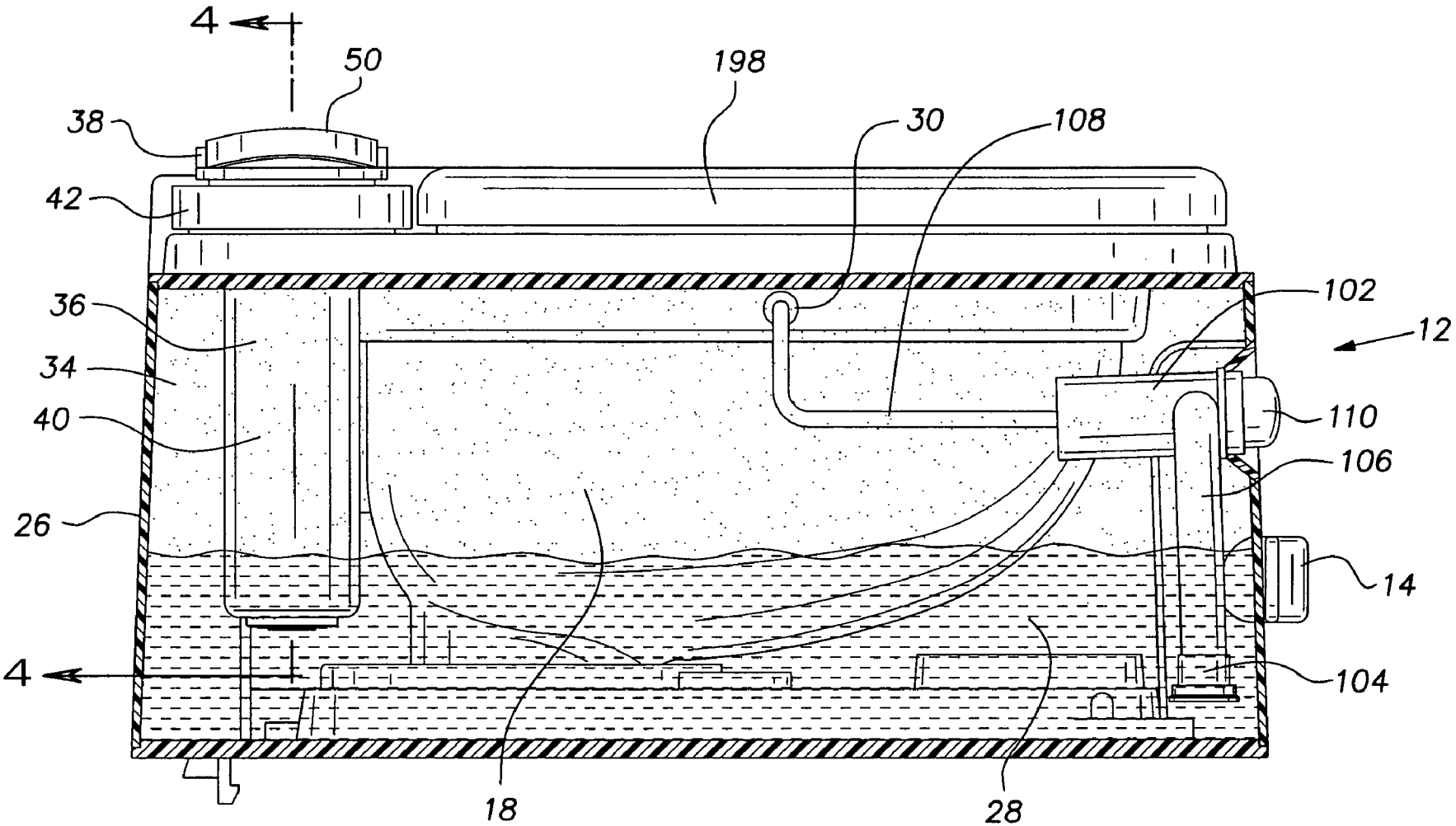
FIG. 3 is a sectional view of the example portable toilet along line 3-3 of FIG. 1.

Turning briefly to the example shown in FIG. 3, the upper section 12 further includes a flush tank 26 adapted to store a fluid 28. This fluid may be referred to as a flushing fluid. In the shown example, the flushing fluid 28 comprises water. It is to be appreciated that the flushing fluid 28 may be any fluid capable of flushing the excrement (not shown) from the bowl 18. It is also to be appreciated that the flushing fluid 28 may be a single fluid, a mixture of fluids, or a mixture of solids and fluids. For example, the flushing fluid 28 may consist of water and a detergent. The storage space within the flush tank 26 for the flushing fluid 28 may include to the interior volume of the flush tank 26 minus the volume of any solid component located within the flush tank 26, such as, for example, the volume occupied by the bowl 18.

Returning to the example shown in FIG. 2, the upper section 12 further includes a nozzle 30 with at least one spout 32 disposed within the bowl 18. The at least one spout 32 is adapted to dispense the flushing fluid 28 into the bowl 18. In the shown example, the nozzle 30 is disposed towards the top of the bowl 18 and includes two spouts 32 oriented 180° from each other. Thus, in the shown example, the two spouts 32 are oriented such that each will dispense the flushing fluid 28 in a direction opposite the other to ensure that the flushing fluid 28 is evenly distributed throughout the bowl 18. It is to be appreciated that any number of nozzles 30 including any number of spouts 32 may be disposed anywhere within the bowl 18.

Turning now to the example shown in FIG. 3, the flush tank 26 is adapted to be pressurized. The flush tank 26 includes a compressible fluid 34 that occupies the remaining volume of the flush tank 26 that is not otherwise occupied by the flushing fluid 28 and/or any solid component. It is to be appreciated that the compressible fluid 34 may be a single fluid or a mixture of fluids. For example, the compressible fluid 34 may include air, a single gas, or a gas mixture. The flush tank 26 becomes pressurized as the pressure of the compressible fluid 34 increases within the flush tank 26. Thus, the compressible fluid 34 is thereby caused to exert a positive pressure upon the flushing fluid 28. As will be later described, it is the positive pressure exerted upon the flushing fluid 28 that causes the flushing fluid 28 to be delivered from the flush tank 26 through the at least one spout 32.

The portable toilet 10 further includes a manually-actuated pump 36 that is in sealed communication with the flush tank 26. The pump 36 is adapted to pump the compressible fluid 34 into the flush tank 26 to thereby cause the flush tank 26 to become pressurized. In the shown example, the pump 36 includes an upper portion 38 disposed outside of the flush tank 26 and a lower portion 40 is disposed inside of the flush tank 26. It is to be appreciated that either, or both, of the upper and lower portions 38, 40 may be disposed inside or outside of the flush tank.

Figure 4:
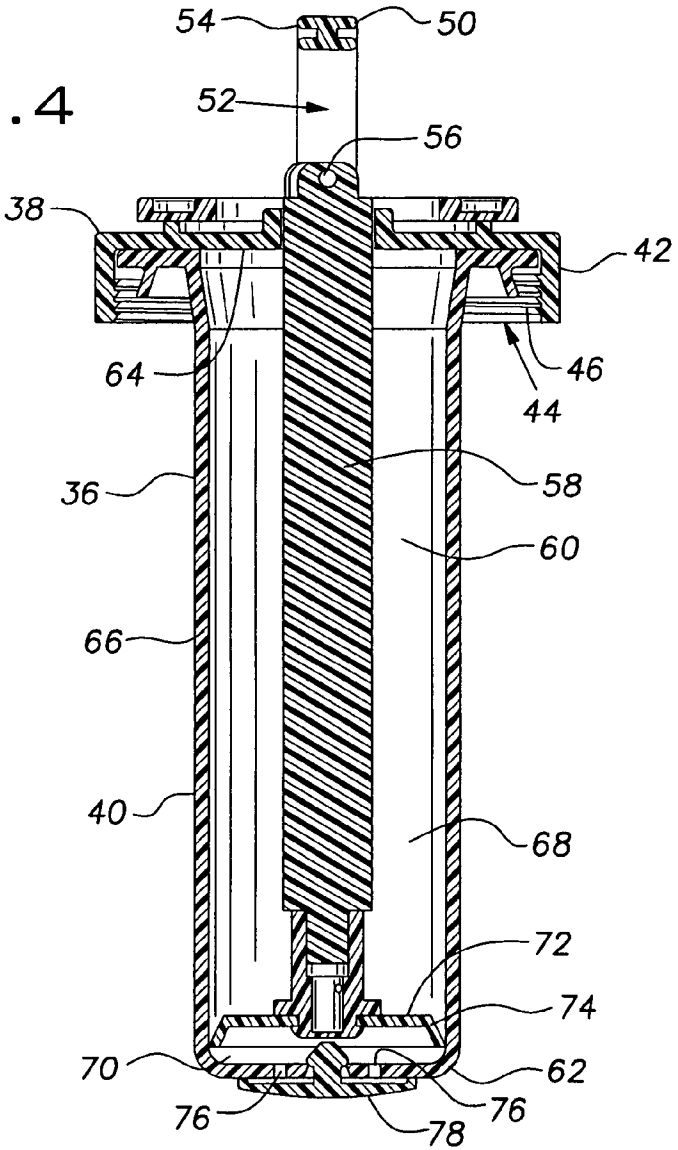
FIG. 4 is a sectional view of an example manually-actuated pump along line 4-4 of FIG. 3.

Turning now to the example shown in FIG. 4, the upper portion 38 includes a cap 42 adapted to removably attach the pump 36 to the flush tank 26. In the shown example, the cap 42 includes a hollow annular ring 44 having internal threads 46 adapted to engage corresponding external threads 48 (FIG. 9) disposed on the flush tank 26. It is to be appreciated that the cap 42 may include any other structure adapted to engage corresponding structure of the flush tank 26 to removably attach the pump 36 thereto, such as, for example, a bayonet fitting. The upper portion 38 further includes a handle 50 to enable a user to operate the pump 36. In the shown example, the handle 50 includes an aperture 52 extending therethrough to create a grasping portion 54 about the outer periphery of the handle 50. The grasping portion 54 is adapted to permit the hand of a user (not shown) to grasp the handle 50 to operate the pump 36. It is to be appreciated that the handle 50 may include any structure adapted to permit a user to operate the pump 36. The handle 50 may also include structure 56 adapted to permit the handle to pivot. In the shown example, the handle 50 is oriented in an operating position parallel to the lower portion 40. In the example shown in FIG. 1, the handle 50 is oriented in a stored position parallel to the cap 42. It is to be appreciated that the handle is not required to pivot, and may include any structure adapted to enable a user to operate the pump.

In the example shown in FIG. 4, the handle 50 is attached to a piston shaft 58 that extends within an interior area 60 of the lower portion 40. In the shown example, the interior area 60 has a generally cylindrical configuration that is defined by a lower end 62, an upper end 64, and a cylindrical sidewall 66. In the example shown in FIG. 3, the lower end 62 is disposed inside of the flush tank 26 and the upper end 64 is disposed outside of the flush tank 26 and is exposed to the ambient atmosphere.

Turning back to the example shown in FIG. 4, a plunger 72 is attached to one end of the piston shaft 58 and further defines the interior area 60 into an ambient area 68 and a pressurized area 70. The plunger 72 may include a lip 74 that abuts the circular sidewall 66 to create a seal between the ambient area 68 and the pressurized area 70. In the shown example, the plunger 72 and the lip 74 include a resilient material and configuration adapted to selectively inhibit fluid communication between the ambient area 68 and the pressurized area 70. The lower end 62 further includes at least one aperture 76 extending therethrough. In the shown example, two apertures 76 are shown. It is to be appreciated that any number of apertures 76 may be disposed anywhere on the lower end 62. The apertures 76 permit the pressurized area 70 to be in fluid communication with the flushing fluid 28 and/or the compressible fluid 34 contained inside the flush tank 26. The pump 36 may further include a one-way valve 78 attached to the lower end 62. The one-way valve 78 is adapted to permit only a one-way transfer of the compressible fluid 34 from the pressurized area 70 to the flush tank 26. In the shown example, the one-way valve 78 includes a resilient material and configuration adapted to selectively inhibit fluid communication between the pressurized area 70 and the flush tank 26.

To operate of the example pump 36 shown in FIG. 4, a user grasps the grasping portion 54 of the handle 50 and pulls it vertically upward to thereby cause the piston shaft 58 and the attached plunger 72 to move vertically upward. As the plunger 72 moves vertically upward, the volume of the ambient area 68 is decreased and ambient air contained therein is forced out through the upper end 64 of the pump 36. Simultaneously, a vacuum is created within the pressurized area 70 as the volume is correspondingly increased and the one-way valve 78 inhibits any transfer of the compressible fluid 34 and/or flushing fluid 28 from the flush tank 26 into the pressurized area 70. Thus, the vacuum causes ambient air from the atmosphere, or any other compressible fluid 34, to be automatically transferred between the ambient portion 68 and the pressurized portion 70. For example, the ambient air may enter the pressurized portion 70 through a valve (not shown) in the end of the piston shaft 58. In an alternate example, the vacuum may cause the resilient lip 74 to flex to permit the ambient air to enter the pressurized portion 70. Next, the user pushes the handle 50 vertically downward to thereby cause the piston shaft 58 and the attached plunger 72 to move vertically downward. The volume of ambient air contained within the pressurized area 70 is forced out of the lower end 62 through the apertures 76 and into the flush tank 26. Because of the structure of the pump, and because there is often some amount of flushing fluid 28 and/or compressible fluid 34 contained within the flush tank 26, the pressure of the ambient air may increase during this process. The lip 74 is configured to inhibit transfer of the ambient air back into the ambient area 68 despite any increase in pressure. The one-way valve 78 is adapted to flex in response to any increase in pressure within the pressurized area 70 to permit the transfer of the compressible fluid 34 from the pump 36 into the flush tank 26. Thus, the flush tank 26 will thereby become pressurized as the compressible fluid 34 is pumped into the fixed volume of the flush tank 26.

It is to be appreciated that the description of the example manually-actuated pump 36 is not intended to be a limitation on the present invention. Any manually-actuated pump 36 having any configuration adapted to pump a compressible fluid 34 into the flush tank 26 to thereby pressurize the flush tank 26 may be used.

Returning briefly to the example shown in FIG. 2, the portable toilet 10 further includes a pressure relief device or valve 80. The pressure relief valve 80 is adapted to release pressure from the flush tank 26 above a predetermined pressure. For example, the pressure relief valve 80 could be adapted to release pressure from the flush tank 26 to prevent an unsafe overpressure condition, or it could be adapted to maintain a desired operating pressure within the flush tank 26 to regulate or enhance performance of the portable toilet 10. In the example shown in FIG. 2, the pressure relief valve 80 is attached to a fill cap 82. The fill cap 82 is in sealing engagement with a fill tube 84 (FIG. 9) attached to the flush tank 26. Thus, the fill cap 82 is in a sealed relationship with the flush tank 26. In the shown example, the fill tube 84 has a generally cylindrical configuration and is formed with the flush tank 26. It is to be appreciated that the fill tube 84 may have any configuration and may be attached to the flush tank 26, either directly or indirectly, in any manner.

Figure 5:
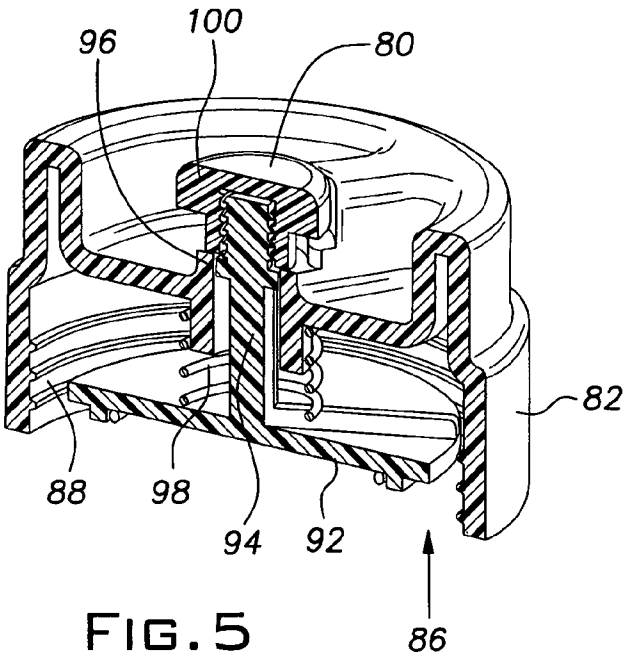
FIG. 5 is a sectional view of an example pressure relief valve along line 5-5 of FIG. 1.

Turning now to the example shown in FIG. 5, the fill cap 82 includes a hollow annular ring 86 having internal threads 88 adapted to engage corresponding external threads 90 (FIG. 9) disposed on the fill tube 84. It is to be appreciated that the fill cap 82 may include any other structure adapted to sealingly engage corresponding structure of the fill tube 84 to removably attach the fill cap 82 thereto, such as, for example, a bayonet fitting. When the fill cap 82 is attached to the fill tube 84, the area defined by the hollow annular ring 86 is in fluid communication with the compressible fluid 34 contained within the flush tank 26.

In the example shown in FIG. 5, the pressure relief valve 80 comprises a poppet valve. Thus, the pressure relief valve 80 includes a pressure plate 92 adapted to respond to the pressure of the compressible fluid 34 contained within the flush tank 26. A stem 94 is attached to the pressure plate 92 and is adapted to move perpendicular to a valve seat 96. The valve seat 96 provides a sealing engagement between the pressure relief valve 80 and the atmosphere. The pressure plate 92 is held in place by a resilient member 98, such as, for example, a spring, which applies a force to bias the poppet valve to a closed position. In operation, pressure within the flush tank 26 will be automatically relieved through the valve seat 96 when the force applied by the compressible fluid 34 upon the pressure plate 92 is greater than the biasing force provided by the resilient member 98 to move the stem 94 and valve seat 96 vertically upward. The pressure at which the pressure relief valve 80 is intended to automatically relieve pressure from the flush tank 26 may be modified by replacing the resilient member 98 with another having a different spring constant.

The pressure relief valve 80 may further include a manually-actuated element 100. Thus, the pressure relief valve 80 may be capable of being manually-actuated to relieve pressure from the flush tank 26. For example, a user may wish to manually regulate the pressure within the flush tank 26 to enhance performance of the toilet. Alternatively, the user may wish to relieve pressure within the flush tank 26 when the portable toilet 10 will be placed into storage for an extended period of time. In the shown example, the manually-actuated element 100 is a button attached to the stem 94 of the valve 80. In operation, a user pushes vertically downward on the button 100. Pressure within the flush tank 26 will thereby be relieved through the valve seat 96. Alternatively, the manually-actuated element 100 may comprise a handle adapted to relieve pressure from the flush tank 26 when the user pulls it vertically upward.

It is to be appreciated that the description of the example pressure relief valve 80 as a poppet valve is not intended to be a limitation on the present invention. Any pressure relief valve 80 having any configuration adapted to automatically and/or manually relieve pressure from the flush tank 26 may be used.

Returning now to the example shown in FIG. 3, the portable toilet 10 further includes a manually-actuated flush valve 102 in sealed communication with the flush tank 26.

The flush valve 102 includes a fluid inlet 104 disposed towards the bottom of the flush tank 26. The fluid inlet 104 is connected to the flush valve. The fluid inlet 104 may include additional elements, such as, for example, an inlet pipe 106 or a filter (not shown). The flush valve 102 also includes a fluid outlet 108 connected to the at least one spout 32. In the shown example, the fluid outlet 108 is connected directly to the nozzle 30, and is thereby connected indirectly to the at least one spout 32. The flush valve 102 is normally biased to a closed position, such that the fluid communication is inhibited between the fluid inlet 104 and the fluid outlet 108. It is to be appreciated that the flush valve 102 may be any valve adapted to be normally biased to a closed position.

The flush valve 102 further includes a flush valve actuator 110 disposed outside of the flush tank 26. The flush valve actuator 110 is adapted to selectively actuate the flush valve 102 to an open position. The flush valve actuator 110 may comprise any structure adapted to selectively actuate the flush valve 102 to an open position, such as a flush button. For example, the flush valve 102 will be actuated to an open position when a user pushes the flush button 110. In operation, actuation of the flush button 110 (i.e., by pushing on it) causes the flush valve 102 to attain an open position to thereby permit fluid communication between the fluid inlet 104 and the fluid outlet 108. Thus, the force applied by the compressible fluid 34 upon the flushing fluid 28 within the flush tank 26 forces the flushing fluid 28 to be delivered from the fluid inlet 104, through the flush valve 102 to the fluid outlet 108, and finally through the at least one spout 32. As such, the flushing fluid 28 will be delivered continuously through the at least one spout 32 and into the bowl 18 so long as the flush valve 102 is actuated. It is to be appreciated that the compressible fluid 34 contained within the flush tank 26 has a greater pressure than the atmosphere outside of the flush tank 26, and/or the fluid inlet 104 is in fluid communication with the flushing fluid 28 contained within the flush tank 26. If either of these conditions of operation are not met, the user may remedy the conditions, respectively, either by using the pump 36 to pump more compressible fluid 34 into the flush tank 26, or by adding more flushing fluid 28 to the flush tank 26 through the fill tube 84.

It is to be appreciated that the description of the example flush valve 102 is not intended to be a limitation on the present invention. It is to be appreciated that any flush valve 102 having any configuration adapted to selectively permit fluid communication between a fluid inlet 104 and a fluid outlet 108 to thereby cause flushing fluid 28 to be delivered through the at least one spout 32 may be used.

Figure 6B:
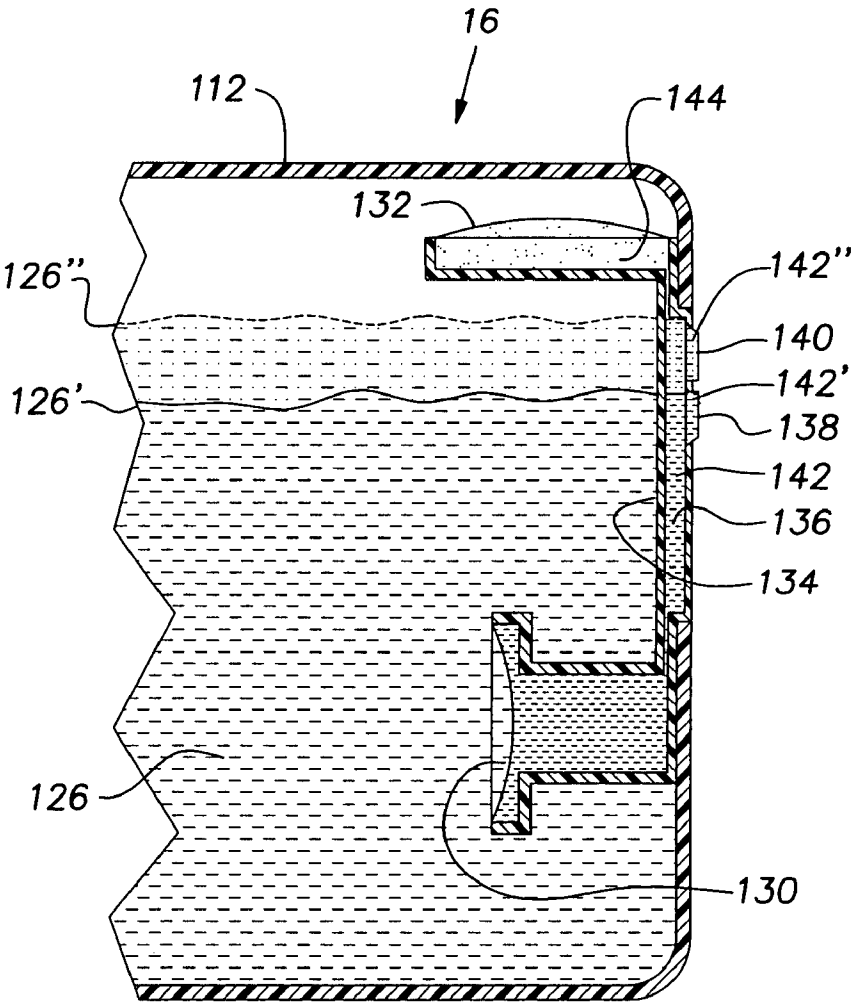
FIG. 6B is similar to FIG. 6A, but shows various levels of waste fluid contained within the holding tank.
Figure 6A:
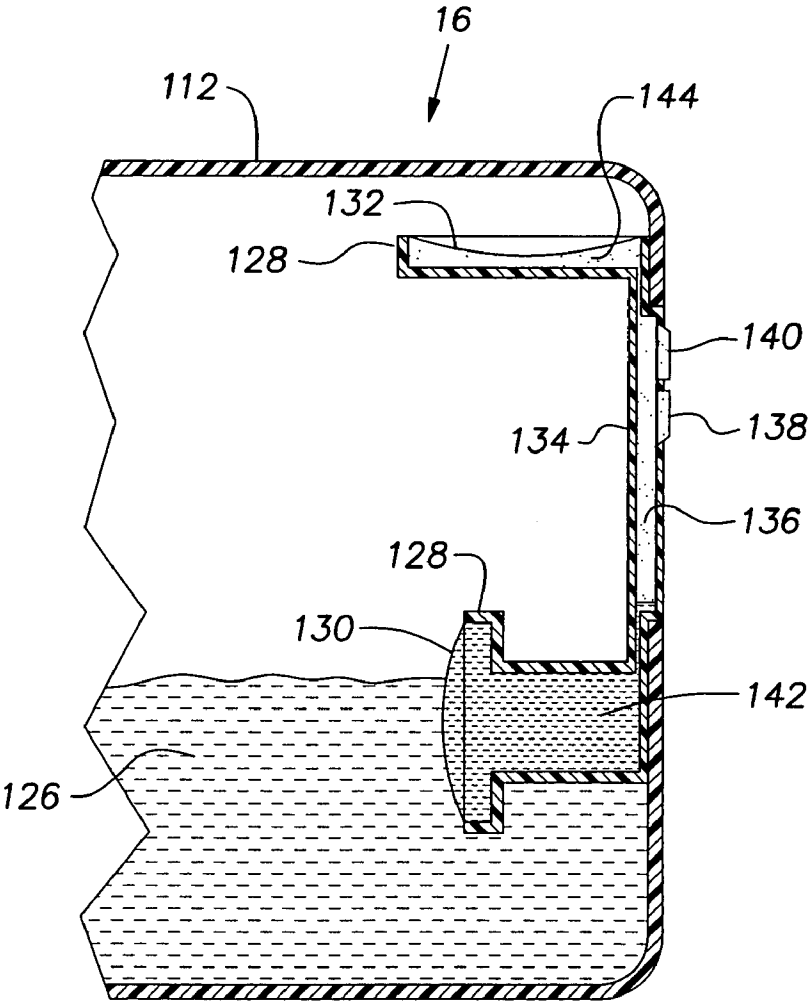
FIG. 6A is a sectional view of an example level indicator device along line 6-6 of FIG. 7.

Returning now to the example shown in FIG. 1, the lower section 16 of the portable toilet 10 includes a holding tank 112. The holding tank 112 is adapted to store a waste fluid 126 (FIG. 6A). The waste fluid 126 may contain, for example, spent flushing fluid and excrement. It is to be appreciated that the waste fluid may contain other fluids, such as detergents, and may even contain other solids. Turning briefly to the example shown in FIG. 7, the holding tank 112 further includes an inlet 114 adapted to receive the waste fluid 126 from the outlet 24 of the bowl 18. The inlet 114 of the holding tank 112 may be connected to the outlet 24 of the bowl 18 either directly, such as when the upper section 12 is placed on top of the lower section 16, or indirectly, such as by plumbing when the upper section 12 is spaced a distance from the lower section 16.

The holding tank 112 may further include a valve 116 adapted to selectively inhibit fluid communication between the outlet 24 of the bowl 18 and the inlet 114 of the holding tank 112. In the shown example, the valve 116 is a slide valve connected to a handle 118. Thus, a user is capable of selectively opening the slide valve 116 by pulling on the handle 118 when it is desired to empty the contents of the bowl 18 into the holding tank 112. The slide valve 116, and/or the handle 118, may further include structure (not shown) adapted to ensure that the slide valve 116 is normally biased to a closed position. The holding tank 112 may further include at least one pressure equalization valve 120 adapted to ensure that the pressure within the holding tank 112 is equal to atmospheric pressure to thereby prevent any backpressure from building up within the holding tank 112. For example, bubbles (not shown) may form within the holding tank and thereby prevent the contents of the bowl 18 from entering the holding tank 112. In the shown example, the holding tank includes two equalization valves 120 disposed adjacent to the inlet 114. It is to be appreciated that any number of equalization valves 120 may be disposed anywhere on the holding tank 112. It is also to be appreciated that the equalization valves 120 may be automatically or manually actuated. For example, the slide valve 116 may include structure (not shown) adapted to actuate the equalization valves 120. The holding tank 112 may further include a handle 122 to aid a user in transporting the holding tank 112, and may also include at least one tank mount 123 adapted to help secure the upper tank 12 to the lower tank 16.

Returning briefly to the example shown in FIG. 1, the lower section 16 includes a level indicator device 124. The level indicator device 124 is adapted to provide an indication of the level of waste fluid 126 contained within the holding tank 112. In the shown example, the level indicator device 124 is disposed towards the front of the lower section 16 to provide a visual indication to a user located in front of the portable toilet 10. It is to be appreciated that the level indicator device may be disposed anywhere on the lower section.

Turning now to the example shown in FIG. 6A, the level indicator device 124 includes a plurality of diaphragms 128, wherein at least a first diaphragm 130 is disposed towards the bottom of the holding tank 112 and at least a second diaphragm 132 is spaced a distance vertically from the first diaphragm 130. It is to be appreciated that any number of diaphragms 128 may be disposed within the holding tank 112 provided that at least one is disposed towards the bottom and at least one is spaced a distance vertically therefrom. Each diaphragm includes a resilient material adapted to permit the diaphragm to flex in response to an externally applied force. In the shown example, only a portion of each diaphragm 128 includes the resilient material. It is to be appreciated that only a part, or the whole, of the diaphragms 128 may include the resilient material.

The level indicator device 124 further includes a sight glass 134 defining an interior area 136 sealed by the diaphragms 128. In the shown example, the sight glass 134 is oriented such that the interior area 136 extends vertically between the first diaphragm 130 and the second diaphragm 132. The sight glass 134 may include a visible portion adapted to provide a direct visual indication of the level of the waste fluid 126. In the shown example, the sight glass 134 includes a first visible portion 138 and a second visible portion 140 that are adapted to provide a visible indication of the level of the waste fluid 126 to a user (not shown) located adjacent to the portable toilet 10. It is to be appreciated that the sight glass 134 may include any number of visible portions disposed anywhere on the lower section 16. It is also to be appreciated that the sight glass 134 may be adapted to provide an indirect visual indication of the level of the waste fluid 126, such as, for example, by using a mechanical or electronic display.

The sight glass 134 further includes an indicator fluid 142 disposed within the interior area 136. The indicator fluid 142 has a viscosity that permits it to flow freely within the interior area 136. In the shown example, the indicator fluid 142 has a specific gravity similar to that of the waste fluid 126 such that the indicator fluid 142 is able to best respond to changes in the level of the waste fluid 126. It is to be appreciated that different indicator fluids 142 may be used having different physical properties, such as viscosity and specific gravity, to achieve any desired performance of the level indicator device 124 as required by any configuration thereof.

In the example shown in FIG. 6A, the first diaphragm 130 is disposed towards the bottom of the holding tank 112 such that it is in fluid communication with the waste fluid 126. When the level of the waste fluid 126 is low, as is shown, the indicator fluid 142 remains disposed primarily within the first diaphragm 130. However, a portion of the indicator fluid 142 may be disposed within the interior area 136 of the sight glass 134. Turning now to the example shown in FIG. 6B, the first diaphragm 130 is configured to flex a predetermined amount in response to hydrostatic pressure exerted by the waste fluid 126 contained within the holding tank 112. Thus, as the level of the waste fluid 126 increases, a greater hydrostatic pressure exerted upon the first diaphragm 130 causes a greater flexure of the first diaphragm 130. As such, the interior volume of the first diaphragm 130 is decreased a corresponding amount to thereby cause the indicator fluid 142 to automatically rise within the interior area 136 of the sight glass 134. Therefore, an indication is provided of the level of waste fluid 126 contained within the holding tank 112.

The sight glass 134 may be configured to provide an indication that the level of the waste fluid 126 contained within the holding tank 112 has reached a predetermined level. For example, as is shown in FIG. 6B, the indicator fluid 142' is only visible to a user within the first visible portion 138 when the waste fluid 126 reaches a three-quarters full condition 126'. As an additional example, the indicator fluid 142" is only visible to a user within the second visible portion 140 when the waste fluid 126 reaches a full condition 126". It is to be appreciated that the sight glass 134 may be configured to provide an indication of any number of predetermined levels, and may even be configured to show the entire range of waste fluid 126 levels, from empty to full.

Additionally, a compressible fluid 144, such as air, a single gas, or a gas mixture, may be disposed within the interior area 136 in fluid communication with the second diaphragm 132. The second diaphragm 132 is configured to flex as required in response to any pressure exerted by the compressible fluid 144. Thus, as the indicator fluid 142 rises within the interior area 136 to occupy a greater volume thereof, a corresponding volume of the compressible fluid 144 will be displaced into the second diaphragm 132. As such, the increasing volume of indicator fluid 142 within the interior area 136 will thereby cause the second diaphragm 132 to flex an amount corresponding to the volume of compressible fluid 144 displaced from the interior area 136. The amount of flexure of the second diaphragm 132 may be regulated to a predetermined amount to prevent the indicator fluid 142 from rising beyond a predetermined level within the sight glass 134, despite a further increase in the level of waste fluid 126 within the holding tank 112.

Figure 7:
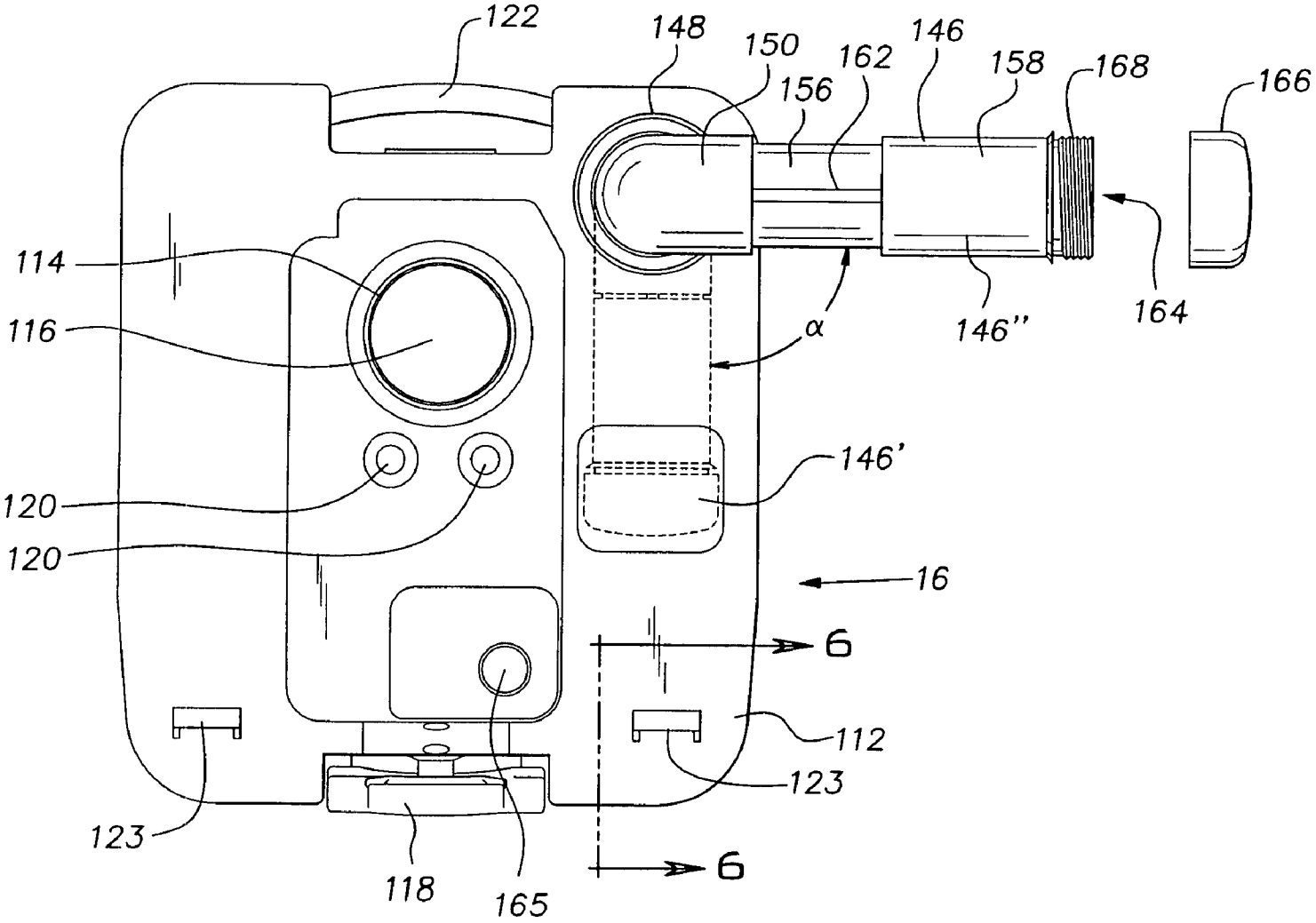
FIG. 7 is a top view of an example holding tank.

Turning now to the example shown in FIG. 7, the lower section 16 may include an outlet 148 adapted to remove the waste fluid 126 from the holding tank 112. The lower section 16 may further include an extensible disposal tube 146 configured to engage the outlet 148 and adapted to empty the waste fluid 126 from the holding tank 112. The extensible disposal tube 146 is adapted to rotate relative to the holding tank 112. In the shown example, the disposal tube 146 has been rotated an angle $\alpha$ from a storage position 146' to a disposal position 146". It is to be appreciated that the disposal tube 146 may be rotated to any angle as required. It is also to be appreciated that the disposal tube 146 may be attached to the holding tank 112 in the storage position 146' when the upper section 12 is placed on top of the lower section. It is further to be appreciated that the portable toilet 10 may include structure adapted to permit the disposal tube 146 to be capable of rotation when the upper section 12 is placed on top of the lower section 16.

Figure 8A:
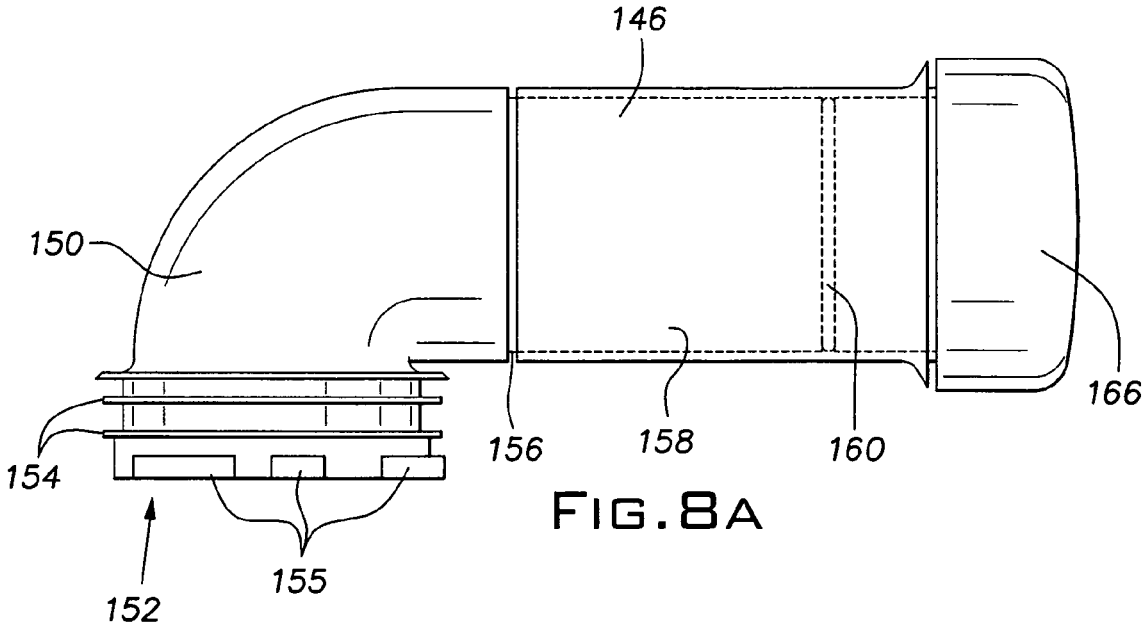
FIG. 8A is a side view of an example extensible disposal tube.

Turning to the example shown in FIG. 8A, the extensible disposal tube 146 includes a curved portion 150 adapted to engage the outlet 148. The curved portion 150 includes an inlet 152 adapted to be in fluid communication with the waste fluid 126 from the holding tank 112. The curved portion 150 further includes sealing structure 154 adapted to seal the connection between the extensible disposal tube 146 and the holding tank 112. In the shown example, the sealing structure 154 includes a plurality of flexible rings adapted to abut the interior wall of the outlet 148 of the holding tank 112. It is to be appreciated that the sealing structure 154 may include any structure adapted to provide a sealed connection between the disposal tube 146 and the holding tank 112. The extensible disposal tube 146 may further be adapted to be removably connected to the holding tank 112. In the shown example, the disposal tube 146 includes a bayonet fitting 155 adapted to provide a quick disconnect function that is also capable of rotation.

In the example shown in FIG. 8A, the extensible disposal tube 146 further includes a first elongated portion 156 and a second elongated portion 158 adapted to move relative to the first elongated portion 156. In the shown example, the elongated portions 156, 158 both have a generally cylindrical configuration, and the inner diameter of the second elongated portion 158 is slightly greater than the outer diameter of the first elongated portion 156. As such, the first elongated member 156 is capable of being disposed within the second elongated member 158. The first elongated member 156 is fixedly attached to the curved portion 150, and the second elongated portion 158 is attached to the first elongated portion 156 by a sealing member 160. In the shown example, the sealing member is an o-ring. It is to be appreciated that the sealing member 160 may include any sealing member adapted to maintain a sealed connection between the elongated portions 156, 158 while permitting the second elongated portion 158 to move relative to the first elongated portion 156.

Turning back to the example shown in FIG. 7, the extensible disposal tube 146 may be adapted to telescope. In the shown example, the overlapping second elongated portion 158 is adapted to slide inward or outward over the first elongated portion 156 to adjust the length of the extensible disposal tube 146 to a desired length. For example, the extensible disposal tube 146 may be extended to a long length to thereby reduce back strain on a user who is attempting to empty the waste fluid 126 from the holding tank 112. The elongated portions 156, 158 may further include alignment structure 162, such as, for example, a tongue and groove, adapted to maintain the alignment of the second elongated portion 158 when it telescopes relative to the first elongated portion 156. It is to be appreciated that any structure adapted to extend the disposal tube 146 may be used. For example, the disposal tube may include a bellows or accordion-style extendable structure, or separate extension tubes adapted to be fixedly connected to the disposal tube the thereby lengthen it.

The disposal tube 146 further includes an outlet 164 disposed at one end of the second elongated portion 158. A removable cap 166 is adapted to cover and seal the outlet 164. The second elongated portion 158 may include sealing structure 168, such as threads, a bayonet fitting, or the like, adapted to provide a sealed connection between the cap 166 and the outlet 164. It is to be appreciated that any structure adapted to cover and seal the outlet 164 may be used.

To empty the waste fluid 126 from holding tank 112 in the shown example, a user first removes the upper section 12 from the lower section 16. Next, the user rotates the extensible disposal tube 146 away from the holding tank 112. Next, the user telescopes the second elongated portion 158 away from the first elongated portion 156. Next, the user removes the cap 166. Finally, the user tips the holding tank to allow gravity to remove the waste fluid 126 from the holding tank, through the disposal tube 146 and out the outlet 164. Additionally, the holding tank 112 may further include a vent 165 adapted to equalize the pressure inside of the holding tank 112 with the atmosphere outside of the holding tank 112. In the shown example, the vent 165 comprises a manually-actuated vent 165 that is resiliently biased to a closed position. In operation, a user can manually open the vent 165 by pressing on it with a finger. Alternatively, the vent 165 may be adapted to operate automatically. Air from the atmosphere is permitted to enter the holding tank 112 through the vent 165, as opposed to through the extensible disposal tube 146, as the waste fluid 126 is being emptied from the holding tank 112. Thus, use of the vent 165 permits the waste fluid 126 to be removed from the waste tank 112 in an even and unimpeded fashion. It is to be appreciated that not all of these steps are required, and even more may be included, to remove the waste fluid 126 from the holding tank 112.

Figure 9:
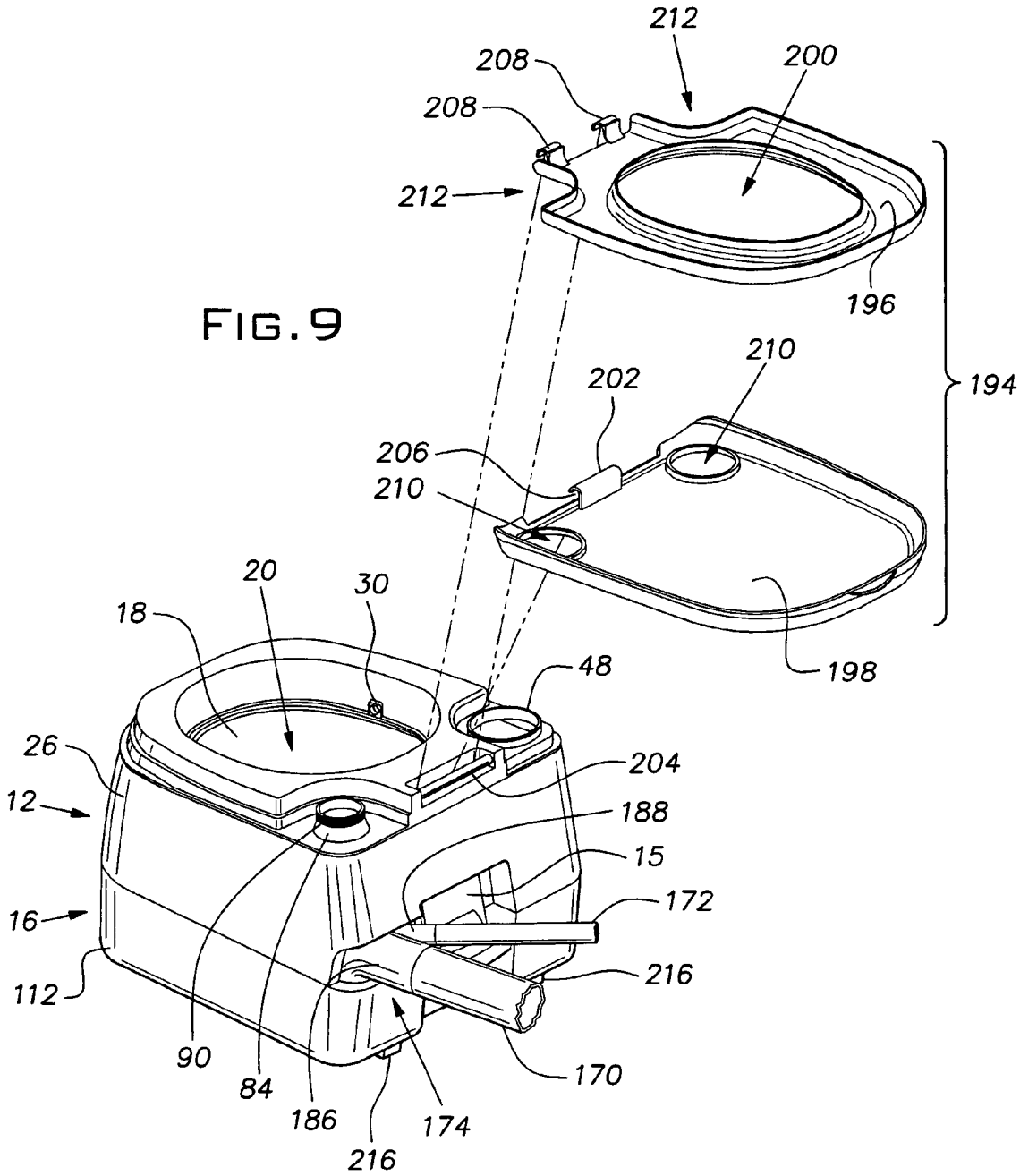
FIG. 9 is a rear perspective view of the example portable toilet.

Turning briefly to the example shown in FIG. 9, the portable toilet 10 may alternatively be connected to a marine sanitation device (MSD, not shown). Larger vehicles, such as larger boats and ships, may include a marine sanitation device adapted to provide automatic removal of waste fluid 126 from the holding tank 112 of a portable toilet 10. For example, the marine sanitation device may include a vacuum pump system having a vacuum line 170 adapted to automatically transfer the waste fluid 126 to a separate, and often larger, holding tank carried aboard the vehicle. Often, vacuum pump systems also provide a vent line 172 adapted to prevent a continuous underpressure condition within the holding tank 112.

Figure 8B:
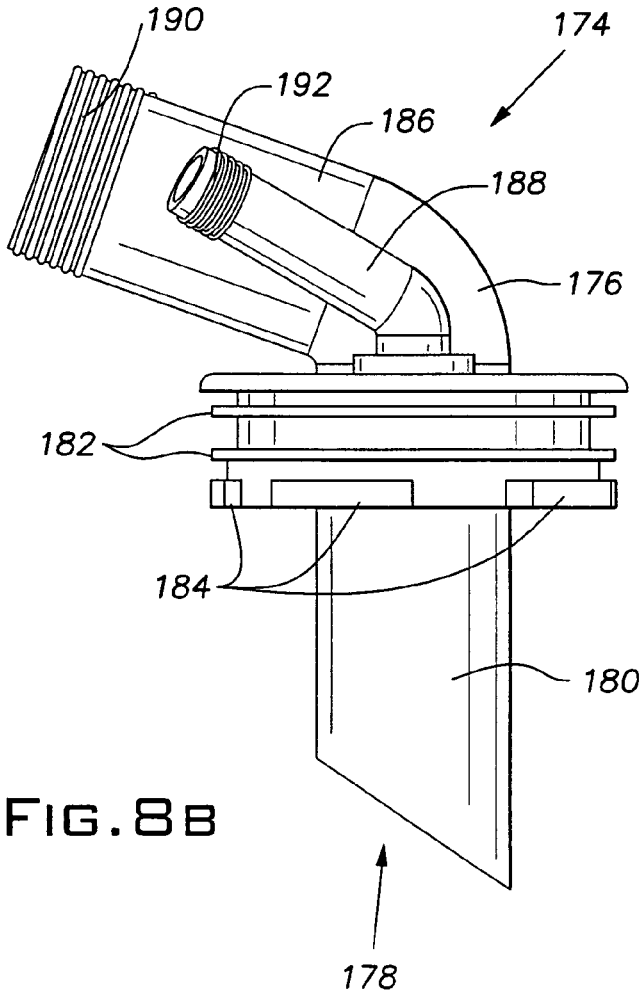
FIG. 8B is a side view of an example permanent disposal tube.

Turning now to the example shown in FIG. 8B, the portable toilet 10 may be provided with a permanent disposal tube 174, such as, for example, a MSD adapter, to connect the holding tank 112 to a marine sanitation device aboard a vehicle. The MSD adapter 174 includes a curved portion 176 adapted to engage the outlet 148 of the holding tank 112. The curved portion 176 includes an inlet 178 adapted to be in fluid communication with the waste fluid 126 from the holding tank 112. The inlet 178 may be connected to an elongated tube 180 configured to locate the inlet 178 close to the bottom of the waste tank 112 to ensure most, if not all, of the waste fluid 126 can be removed. The curved portion 176 further includes sealing structure 182 adapted to seal the connection between the MSD adapter 174 and the holding tank 112. In the shown example, the sealing structure 182 includes a plurality of flexible rings adapted to abut the interior wall of the outlet 148 of the holding tank 112. It is to be appreciated that the sealing structure 182 may include any structure adapted to provide a sealed connection between the MSD adapter 174 and the holding tank 112. The MSD adapter 174 may further be adapted to be removably connected to the holding tank 112. In the shown example, the MSD adapter 174 includes a bayonet fitting 184 adapted to provide a quick disconnect function that is also capable of rotation.

The curved portion 176 further includes a disposal tube 186 adapted to be connected to the marine sanitation device. The disposal tube 186 includes sealing structure 190 adapted to provide a sealed connection to the marine sanitation device. In the shown example, the disposal tube 186 includes a threaded connection 190 adapted to provide a sealed connection to the vacuum line 170 (FIG. 9). The MSD adapter 174 may further include a pressure equalization tube 188 adapted to be connected to the vent line 172 of the marine sanitation device. The pressure equalization tube 188 is adapted to be in fluid connection with the flush tank 26 to ensure that a continuous underpressure condition is not maintained therein. The pressure equalization tube 188 includes sealing structure 192, such as, for example, threads, adapted to provide a sealed connection to the marine sanitation device. It is to be appreciated that any sealing structure 190, 192 may be used that provides a sealed connection between the MSD adapter and the marine sanitation device of the vehicle.

It is to be appreciated that the extensible disposal tube 146 and the permanent disposal tube 174 are intended to be alternatively attached to the holding tank 112. For example, the extensible disposal tube 146 may be attached to the holding tank 112 to provide a truly portable toilet. Alternatively, the MSD adapter 174 may be attached to the holding tank 112 to provide a more permanent, automatic toilet. It is further to be appreciated that a single disposal tube may include the elements and functionality of both the extensible disposal tube 146 and the MSD adapter 174 to enable a user to conveniently and selectively utilize either the portable or permanent feature set.

Turning now to the example shown in FIG. 9, the portable toilet 10 may include a seat assembly 194. The seat assembly 194 includes a seat 196 and a lid 198 adapted to cover the seat 196. Turning briefly to the example shown in FIG. 2, the seat 196 provides a support surface 197 adapted to support a user that is seated upon the portable toilet 10. The seat 196 includes a large hole 200 disposed therethrough to permit access to the bowl 18. It is to be appreciated that although the seat 196 is shown as an element separate and apart from the upper section 12, the seat 196 may alternatively be formed with the upper section 12 as one unit. The seat assembly 194 further includes a first hinge 202 adapted to pivotally attach the lid 198 to the upper section 12. In the shown example, the lid 198 is capable of being pivoted about a shaft 204 (FIG. 9) to an angle β relative to the upper section 12.

Returning now to the example shown in FIG. 9, the lid 198 is adapted to be removed from the upper section 12 when the first hinge 202 is pivoted to a predetermined angle relative to the upper section 12. In the shown example, the first hinge 202 has an elongated, substantially U-shaped profile with a semi-circular trough 206 adapted to engage with the shaft 204 of the upper section 12. Thus, the semi-circular trough 206 is adapted to receive and substantially wrap around a portion of the shaft 204 to provide a pivotable connection. Because the U-shaped profile has an opening opposite the trough 206, the shaft 204 is capable of being removed from the trough 206 through the opening. In the shown example, the shaft 204 is capable of being removed from the trough 206 when the lid 198 is pivoted approximately 180° relative to the upper section 12. When the lid 198 is pivoted to an angle β substantially less than 180°, the configuration of the upper section 12 prevents the shaft 204 from being removed from the trough 206. It is to be appreciated that the first hinge 202 may include any hinge capable of being removed from the portable toilet 10 when pivoted to a predetermined angle relative to the upper section 12. It is also to be appreciated that the angle at which the lid 198 is released may vary as required by the configuration of the portable toilet 10.

The seat 196 may further include a second hinge 208 adapted to pivot the seat 196 about the shaft 204 to an angle relative the upper section 12. In the shown example, the seat 196 includes a pair of second hinges 208. In the shown example, the second hinges 208 each have an elongated, substantially U-shaped profile similar to that of the first hinge 202. It is to be appreciated that the second hinges 208 operate in substantially the same way as the first hinge 202. Thus, the second hinges 208 are capable of being removed from the upper section 12 when the seat 196 is pivoted approximately 180° relative to the upper section 12. When the seat 196 is pivoted to an angle β substantially less than 180°, the structure of the upper section 12 prevents the shaft 204 from being removed from the U-shaped profile of the second hinges 208. It is to be appreciated that the second hinges 208 may include any hinges capable of being removed from the portable toilet 10 when pivoted to a predetermined angle relative to the upper section 12. It is also to be appreciated that the angle at which the seat 196 is released may vary as required by the structure of the portable toilet 10.

In the shown example, the two second hinges 208 are spaced apart from each other so as to permit the first hinge 202 of the lid 198 to be placed therebetween. Thus, turning briefly to the example shown in FIG. 2, the second hinges 208 are capable of straddling the first hinge 202 so as to permit the seat to be pivoted about the shaft 204 independently from the lid 198. In the shown example, the seat 196 is oriented at approximately 0°, while the lid 198 is oriented at an angle β. Returning to the example shown in FIG. 9, the seat 196 is configured to the nestable within the lid 198. Thus, it is to be appreciated that when both the seat 196 and the lid 198 are pivotally attached to the upper section 12, the lid 198 cannot be oriented at any angle, relative to the upper section 12, less than that of the seat 196.

The lid 198 may further include at least one aperture 210 adapted to permit a portion of the manually-actuated pump 36 to extend through the lid 198. In the shown example, the lid 198 includes two apertures 210, one adapted to permit the handle 50 of the pump 36 to extend therethrough, and the other adapted to permit the fill cap 82 and pressure relief valve 80 to extend therethrough. Additionally, the seat 196 may include an aperture 212 adapted to permit a portion of the pump 36 to extend therethrough. In the shown example, the seat 196 includes two apertures 212 adapted to permit the pump 36, fill cap 82 and pressure relief valve 80 to extend therethrough. Thus, turning to the example shown in FIG. 1, the apertures 210, 212 permit a user to use the pump 36, fill cap 82 and/or pressure relief valve 80 when the lid 198 and/or seat 196 are oriented in a closed position (i.e., approximately 0°). It is to be appreciated that any number of apertures 210, 212 may be disposed anywhere on the seat 196 and lid 198 to permit a user to use any pump 36, fill cap 82 and/or pressure relief valve 80 when the lid 198 and/or seat 196 are oriented in a closed position.

Returning briefly to the example shown in FIG. 9, the portable toilet 10 may further include at least one floor mount 216 adapted to secure the portable toilet 10 to a mounting surface (not shown). For example, the mounting surface may include the floor of a vehicle. In the shown example, two floor mounts 216 are disposed towards the rear of the toilet 10 and are adapted to fixedly engage with corresponding structure of the mounting surface of a vehicle. For example, the floor mounts 216 could include extended tongues adapted to engage slots within the mounting surface. Returning to the example shown in FIG. 1, the portable toilet 10 may further include a mounting release handle 214 adapted to selectively engage and release the portable toilet 10 to the mounting surface (not shown). The mounting release handle 214 may include a resilient member adapted to normally bias the release handle 214 to an engaged position with the mounting surface. Thus, to attach the shown example to the mounting surface of a vehicle, a user first fixedly engages the two floor mounts 216 with the slots (not shown) of the mounting surface. Next, the user selectively engages the mounting release handle 214 to selectively engage the portable toilet to the mounting surface. To release the portable toilet 10 from the mounting surface, the user grasps the mounting release handle 214 and biases it to a disengaged position with the mounting surface. Next, the user disengages the two floor mounts 216 from the slots of the mounting surface. It is to be appreciated that the handle 14 of the upper section 12 may be used to help position the toilet 10 during these procedures.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A portable toilet, comprising:

a bowl provided with an outlet and at least one spout;

a flush tank adapted to store a fluid, wherein the flush tank is adapted to be pressurized;

a manually-actuated pump in sealed communication with the flush tank, wherein the pump is adapted to cause the flush tank to become pressurized;

a pressure relief device adapted to release pressure from the flush tank;

a manually-actuated flush valve in sealed communication with the flush tank and normally biased to a closed position, including a fluid outlet connected to the at least one spout and a fluid inlet; and a flush valve actuator disposed outside of the flush tank and adapted to actuate the flush valve, wherein actuation of the flush valve actuator causes the flush valve to open to permit pressurized fluid contained within the flush tank to be delivered through the at least one spout.

2. The portable toilet as provided in claim 1, wherein the at least one spout comprises two spouts.

3. The portable toilet as provided in claim 2, wherein the two spouts are configured to dispense the fluid in opposite directions.

4. The portable toilet as provided in claim 1, wherein the pressure relief device is configured to automatically relieve pressure from the flush tank above a predetermined amount.

5. The portable toilet as provided in claim 4, wherein the pressure relief device is capable of being manually-actuated to relieve pressure from the flush tank.

6. The portable toilet as provided in claim 4, wherein the flush tank includes a fill tube adapted to receive the fluid and a fill cap in sealed communication with the fill tube and flush tank, wherein the fill cap includes the pressure relief device.

7. The portable toilet as provided in claim 1, wherein the pump is adapted to pump a compressible fluid into the flush tank to thereby cause the flush tank to become pressurized.

8. The portable toilet as provided in claim 1, wherein the fluid inlet is disposed towards the bottom of the flush tank.

9. A portable toilet, comprising:

a portable upper section including a bowl;

a flush tank adapted to store a fluid;

a seat assembly including a seat and a lid adapted to cover the seat; and a first hinge adapted to pivotally attach the lid to the upper section, wherein the lid is adapted to be removed from the upper section when the first hinge is pivoted to a predetermined angle relative to the upper section, manually-actuated pump in sealed communication with the flush tank, wherein the pump is adapted to cause the flush tank to become pressurized, and wherein the lid further comprises at least one aperture adapted to permit a portion of the manually-actuated pump to extend through the lid.

10. The portable toilet as provided in claim 9, wherein the first hinge is substantially U-shaped.

11. The portable toilet as provided in claim 9, further comprising a second hinge adapted to pivotally attach the seat to the upper section.

12. The portable toilet as provided in claim 11, wherein the seat is adapted to be removed from the upper section when the second hinge is pivoted to a predetermined angle relative to the upper section.

13. The portable toilet as provided in claim 12, wherein the second hinge is substantially U-shaped.

14. The portable toilet as provided in claim 12, where in the lid and the seat are each adapted to be removed from the upper section when the first hinge and the second hinge are pivoted approximately 180° relative to the upper section.

15. The portable toilet as provided in claim 9, wherein the seat further comprises at least one aperture adapted to permit a portion of the manually-actuated pump to extend through the seat.

16. A portable toilet, comprising:

a portable upper section including a bowl;

a flush tank adapted to store a fluid;

a seat assembly including a seat and a lid adapted to cover the seat; and a first hinge adapted to pivotally attach the lid to the upper section, wherein the lid is adapted to be removed from the upper section when the first hinge is pivoted to a predetermined angle relative to the upper section, wherein the seat is formed with the upper section.

* * * * *